US008079682B2

(12) United States Patent
Nishimura et al.

(10) Patent No.: US 8,079,682 B2
(45) Date of Patent: Dec. 20, 2011

(54) INKJET RECORDING DEVICE

(75) Inventors: Asayo Nishimura, Tokyo (JP); Masato Hirai, Tokyo (JP); Hitoshi Arai, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 448 days.

(21) Appl. No.: 12/385,102

(22) Filed: Mar. 31, 2009

(65) Prior Publication Data

US 2009/0251511 A1 Oct. 8, 2009

(30) Foreign Application Priority Data

Apr. 7, 2008 (JP) ..... 2008-099495

(51) Int. Cl.
*B41J 2/175* (2006.01)
*B41J 29/38* (2006.01)
*B41J 2/18* (2006.01)

(52) U.S. Cl. ..... 347/85; 347/14; 347/89

(58) Field of Classification Search ..... 347/84–85, 347/89, 14
See application file for complete search history.

*Primary Examiner* — Matthew Luu
*Assistant Examiner* — Lisa Solomon
(74) *Attorney, Agent, or Firm* — Manabu Kanesaka

(57) ABSTRACT

An inkjet recording device has an ink tank, a reservoir and an ink head, forms an ink supplying system by connecting with a path between the ink tank and the reservoir and between the reservoir and the ink head respectively, and forms a meniscus by generating a negative pressure on an ink discharging plane of the ink head by opening the reservoir to atmosphere. The inkjet recording device includes control electromagnetic valves to open or interrupt paths of the ink supplying system and valve switching control means for controlling opening/closing of the control electromagnetic valves, and controls the valve to be closed by the valve switching control means when the device vibrates. As a result, even if an ink liquid level in the reservoir changes when the device vibrates, transmission of this change to the meniscus of the ink discharging plane is prevented or suppressed.

12 Claims, 10 Drawing Sheets

Fig. 5A

| | INTERRUPT BETWEEN RESERVOIR AND INK HEAD | INTERRUPT ATMOSPHERIC OPENING APERTURE OF RESERVOIR |
|---|---|---|
| EFFECT | ◎ | ○ |
| OBJECTIVE SHAKE | ALL SHAKES ○ | HORIZONTAL SHAKE ○<br>VERTICAL SHAKE × |
| MERIT | VERY EFFECTIVE EVEN AGAINST BIG SHAKE | SMALL INFLUENCE ON INK SUPPLY |
| DEMERIT | SIGNIFICANT INFLUENCE ON INK SUPPLY | WEAK AGAINST VERTICAL SHAKE AND BIG SHAKE |

Fig. 5B

| | | |
|---|---|---|
| DURING PRINTING OPERATION | INTERRUPT BETWEEN RESERVOIR AND INK HEAD | OPEN BETWEEN TWO SHEETS OF PAPER |
| DURING PAUSING OF PRINTING | INTERRUPT ATMOSPHERIC OPENING APERTURE OF RESERVOIR | OPEN WHEN PRESSURE CHANGES |
| AT OCCURRENCE OF VIBRATION | INTERRUPT BETWEEN RESERVOIR AND INK HEAD | OPEN WHEN VIBRATION CALMS DOWN |
| WHILE POWER SUPPLY IS OFF | OPEN | MAINTENANCE WHILE POWER SUPPLY IS ON |

INKJET RECORDING DEVICE

BACKGROUND OF THE INVENTION

1. Field of the Invention

The present invention relates to an inkjet recording device that discharges ink from an ink head and performs printing, and interrupts the path of an ink supplying system to prevent the meniscus of an ink discharging plane from being destroyed, when the device vibrates or by the device's estimation of periodic vibration thereof.

2. Description of the Related Art

In the related art, there has been an inkjet recording device that discharges ink from an ink head according to image data and prints it on a recording medium such as a printing paper. FIG. 8 is a drawing that depicts configuration of the path of a general inkjet recording device.

As shown in FIG. 8, an inkjet recording device 101 includes an exchangeable ink bottle 2 that is an ink tank, a reservoir 3 that temporarily stores the ink supplied from the ink bottle 2 and an ink head 4 that discharges the ink supplied from the reservoir 3 through the discharge entrance 5. Moreover, in this inkjet recording device 101, paths 6*a* and 6*b* are connected between the ink bottle 2 and the reservoir 3 and between the reservoir 3 and the ink head 4 respectively, to form the ink supplying system. In addition, an electromagnetic valve 7*a* that opens and interrupts this path 6*a* by controlling the opening/closing when the ink from the ink bottle 2 is supplied in the path 6*a* between the ink bottle 2 and the reservoir 3. Further, the ink bottle 2 includes an atmospheric opening aperture 8*a* to open the inside of the ink bottle 2 to atmosphere.

A waste fluid tank 12 is connected with a path to the reservoir 3 through an overflow tank 11. The overflow tank 11 has been installed to make the ink flow thereinto, for examples, when the ink supplied from the ink bottle 2 to the reservoir 3 is in excess. The ink that flows into the overflow tank 11 is accommodated by the waste fluid tank 12. Moreover, this overflow tank 11 includes an atmospheric opening aperture 8*b* to open the reservoir 3 to atmosphere through a path 6*c*.

In addition, a pressurized pump 13 is connected with the reservoir 3. The pressurized pump 13 has been installed in order to push ink out of the ink supplying system mainly for the purge. Moreover, an electromagnetic valve 7*b* that controls the opening at the time of the purge and opens a path 6*d* between the reservoir 3 and the pressurized pump 13 is installed between the reservoir 3 and the pressurized pump 13.

An ink head 4 (inkjet head) includes an atmospheric opening aperture 8*c*. An electromagnetic valve 7*c* is installed in the atmospheric opening aperture 8*c*. This electromagnetic valve 7*c* usually opens the atmospheric opening aperture 8*c*, and controls the closing only when ink is filled and interrupts the atmospheric opening aperture 8*c*. In addition, discharge entrance 5 is disposed on the plane opposite to the printing paper of the ink head 4.

Moreover, as the ink head 4, there are, for example, a thermal method that generates air bubbles by heating and discharges the ink and a piezo method that uses a piezoelectric element to be transformed by voltage. However, any method may be adopted in this case. Moreover, a line head method in which the ink head 4 is arranged in a direction perpendicular to a transportation direction X in each color of black (K), cyan (C), magenta (M), and yellow (Y) may be adopted, and a serial head method in which the ink head 4 moves in a direction perpendicular to a transportation direction X may be adopted.

Further, each of the electromagnetic valves 7*a* to 7*c* controls the opening/closing by the valve switching control means which is not shown in the figure.

In addition, transportation means 14 to maintain a constant distance from the discharge entrance 5 and to transport printing papers in a predetermined transportation direction X is installed just below discharge entrance 5 of the ink head 4 as shown in FIG. 8. The transportation means 14 includes a pair of rollers 15 and 15 and a transportation belt 16 that is hung and turned around between rollers 15 and 15. Though not shown in the figure, one of a pair of rollers 15 and 15 is a driving roller connected with the driving means, and, the other one is a driven roller.

Moreover, the transportation belt 16 includes an endless belt. In the transportation belt 16, plural suction holes that penetrate between a surface that becomes the transportation plane of printing paper and a rear surface and not shown in the figure have been installed. In addition, the suction fan not shown in the figure is installed on the back side of the transportation belt 16. This suction fan absorbs the printing paper on the surface of the transportation belt 16 by sucking air through the suction holes while transporting the printing paper using the transportation belt 16.

However, in the inkjet recording device 101 mentioned above (FIG. 8), a meniscus is formed by generating a negative pressure on the ink discharging plane Sa by the difference of the height between an ink liquid level in the reservoir 3 and the ink discharging plane 5*a* at the discharge entrance 5 of the ink head 4 (water head difference H) by opening the inside of the reservoir 3 to atmosphere as shown in FIG. 9A during a printing operation by the ink head 4 or during the pause of the printing when the printing operation is not performed. However, when the inkjet recording device 101 receives impact and it vibrates for example, the ink liquid level in the reservoir 3 may change as shown in FIG. 9B, and the change of this ink liquid level may be transmitted to the meniscus of the ink discharging plane 5*a*, and the meniscus may break. When the meniscus breaks, air bubbles mix go into the discharge entrance 5 of the ink head 4 and it causes a defective ink discharge.

Moreover, JP-A-2005-131811 discloses the ink jet printer including the mechanism that interrupts ink supply in response to impact or vibration when the impact or the vibration is applied and prevents the ink leakage from the nozzle. As shown in FIG. 10, the ink leakage preventing mechanism 201 includes a valve body 203 that opens and closes an ink supply path 202 where ink is supplied to the ink head, a biasing member 204 that biases the valve body 203 to a close position, a weight 205, and a mounting surface 206 on which the weight 205 is movably mounted. The ink leakage preventing mechanism 201 further includes a valve control member (a first swing lever 207 and a second swing lever 208) that retains the valve body 203 to an open position by the weight of the weight 205. According to this constitution, the weight 205 separates temporarily from the mounting surface 206 when the impact or the vibration is applied to the printer and when the printer inclines. When the weight 205 separates from the mounting surface 206, the second swing lever 208 swings to disengage from a first swing lever 207 and thereby the first swing lever 207 becomes swingable. As a result, the valve body 203 moves to the close position by the bias force of the bias member 204 and interrupts the ink supply path 202, thus the ink leakage from the nozzle can be prevented.

However, because the above-mentioned ink leakage preventing mechanism (JP-A-2005-131811) controls the opening/closing of the ink supply path 202 physically, there is a slight gap of time to close the ink supply path 202 after the printer vibrated. With this configuration, it is insufficient in terms of speed to prevent transmission of the change of ink liquid level in the reservoir to the meniscus of the ink discharging plane. Furthermore, the configuration is complex and precise as shown in FIG. 10, thus work such as maintenance becomes complex.

In addition, the above-mentioned ink leakage preventing mechanism does not interrupt the ink supply path 202 if the vibration, etc. is not actually applied to the printer. Thus this mechanism is unsuitable for foreseeable vibration (for example, periodic vibration by the operation of the internal mechanism).

SUMMARY OF THE INVENTION

Therefore, the present invention has been invented in consideration of the above-mentioned problems for the purpose of preventing a defective ink discharge by preventing or by suppressing transmission of the change of the ink liquid level to the meniscus of the ink discharging plane even if the ink liquid level in the reservoir changes when the inkjet recording device vibrates, and to provide an inkjet recording device that can be used for foreseeable vibration effectively and has a simple configuration, in addition.

Next, detailed description of the configuration of the above invention for solving the above-mentioned problems will be made with reference to the accompanying drawings corresponding to preferred embodiments of the invention.

The inkjet recording device 1 (1A and 1B) in accordance with a first aspect of the present invention has an ink tank 2, a reservoir 3 that temporarily stores the ink supplied from the ink tank 2 and an ink head 4 that discharges the ink supplied from the reservoir 3 and performs printing, forms an ink supplying system by connecting with a path between the ink tank 2 and the reservoir 3 and between the reservoir 3 and the ink head 4 respectively, and forms a meniscus by generating a negative pressure on an ink discharging plane 5*a* of the ink head 4 by opening the reservoir 3 to atmosphere. Furthermore, the inkjet recording device 1 (1A and 1B) includes valves 21*a* and 21*b* installed in predetermined paths 6*b* and 6*c* of the ink supplying system to open or interrupt the paths 6*b* and 6*c* and valve switching control means 22 for controlling opening/closing of the valves 21*a* and 21*b*, and controls the valve 21*a* and 21*b* to be closed by the valve switching control means 22 when the ink jet recording device vibrates.

In the inkjet recording device in accordance with a second aspect of the present invention, pressure detecting means 10 for detecting the pressure applied to the ink discharging plane 5*a* of the ink head 4 for detecting the vibration of the inkjet recording device 1 (1A and 1B) is installed.

In the inkjet recording device in accordance with a third aspect of the present invention, the valve 21*a* is installed in a path 6*a* between the reservoir 3 and the ink head 4 in the ink supplying system, and the valve switching control means 22 controls the valve 21*a* to be closed during a printing operation by the ink head 4 and controls the valve 21*a* to be opened during a pause of the printing between a printing operation and another printing operation.

In the inkjet recording device in accordance with a fourth aspect of the present invention, when a change of the pressure on the ink discharging plane 5*a* of the ink head 4 is detected by the pressure detecting means 10 during the printing operation by the ink head 4, the valve switching control means 22 controls the valve 21*a* to be closed until the change of the pressure comes into a predetermined range even after the ink head 4 enters the pause of the printing.

In the inkjet recording device in accordance with a fifth aspect of the present invention, when a change of the pressure on the ink discharging plane 5*a* of the ink head 4 is detected by the pressure detecting means 10 during the pause of the printing when the printing operation by the ink head 4 is not performed, the valve switching control means 22 controls the valve 21*a* to be closed until the change of the pressure comes into a predetermined range.

The inkjet recording device 1A in accordance with a sixth aspect of the present invention has an ink tank 2, a reservoir 3 that temporarily stores the ink supplied from the ink tank 2 and an ink head 4 that discharges the ink supplied from the reservoir 3 and performs printing, forms the ink supplying system by connecting with a path between the ink tank 2 and the reservoir 3 and between the reservoir 3 and the ink head 4 respectively, and forms a meniscus by generating a negative pressure on an ink discharging plane 5*a* of the ink head 4 by opening the reservoir 3 to atmosphere. The inkjet recording device 1A includes:

a valve 21*a* that are installed in the path 6*b* between the reservoir 3 and the ink head 4 in the ink supplying system and opens or interrupts the path 6*b;* valve switching control means 22 installed to control opening/closing of the valve 21*a*, for controlling the valve 21*a* to be closed when the ink jet recording device 1A vibrates;

pressure detecting means 10 installed to detect the vibration of the inkjet recording device 1A, for detecting the pressure applied to the ink discharging plane 5*a* of the ink head 4; and error analysis means 40 for analyzing an error that occurs during the printing operation by the ink head 4, wherein the valve switching control means 22 controls the valve 21*a* to be closed during the printing operation by the ink head 4; controls the valve 21*a* to be opened during a pause of the printing between a printing operation and another printing operation of the ink head 4; controls the valve 21*a* to be closed until a change of the pressure comes into a predetermined range even after the ink head 4 enters the pause of the printing when the change of the pressure applied to the ink discharging plane 5*a* of the ink head 4 during the printing operation is detected by the pressure detecting means 10 during the printing operation; controls the valve 21*a* to be closed until the change of the pressure comes into a predetermined range when the change of the pressure is detected by the pressure detecting means 10 during the pause of the printing when the printing operation is not performed; and controls the valve 21*a* to be closed when an error is determined as a predetermined error by the error analysis means 40 if the printing operation stops due to the error during the printing operation.

In the inkjet recording device in accordance with a seventh aspect of the present invention, when an error is determined as the predetermined error by the error analysis means 40, the valve switching control means 22 controls the valve 21*a* to be closed during the time between the determination by the error analysis means 40 and a time when the printing operation stops.

In the inkjet recording device in accordance with an eighth aspect of the present invention, the predetermined error includes paper jamming and the valve switching control means 22 controls the valve 21*a* to be closed when the paper jamming is determined by the error analysis means 40 and controls the valve 21*a* to be opened after the paper jamming is resolved and a predetermined time has passed.

In the inkjet recording device in accordance with a ninth aspect of the present invention, the predetermined error includes paper-out and the valve switching control means 22 controls the valve 21*a* to be closed when an error is determined as the paper-out by the error analysis means 40 and controls the valve 21*a* to be opened after refill of paper is completed and a predetermined time has passed.

The inkjet recording device in accordance with a tenth aspect of the present invention has an ink tank 2, a reservoir 3 that temporarily stores the ink supplied from the ink tank 2 and an ink head 4 that discharges the ink supplied from the reservoir 3 and performs printing, forms the ink supplying system by connecting with a path between the ink tank 2 and the reservoir 3 and between the reservoir 3 and the ink head 4 respectively, and forms a meniscus by generating a negative pressure on an ink discharging plane 5*a* of the ink head 4 by opening the reservoir 3 to atmosphere. Furthermore, the inkjet recording device A1 includes:

a valve 21*a* installed in a path 6*b* between the reservoir 3 and the ink head 4 in the ink supplying system to open or interrupt the path 6*b;* valve switching control means 22 installed to control opening/closing of the valve 21*a*, for controlling the valve 21*a* to be closed when the ink jet recording device 1A vibrates; and error analysis means 40 for analyzing an error that occurs during the printing operation by the ink head 4, wherein the valve switching control means 22 controls the valve 21*a* to be closed during the printing operation by the ink head 4; controls the valve 21*a* to be opened during a pause of the printing between a printing operation and another printing operation of the ink head 4; controls the valve 21*a* to be closed when an error is determined as a predetermined error by the error analysis means 40 if the printing operation stops due to the error during the printing operation; controls the valve 21*a* to be closed when the predetermined error includes paper-out and an error is determined as the paper-out by the error analysis means 40 and controls the valve 21*a* to be opened after refill of paper is completed and a predetermined time has passed; and controls the valve 21*a* to be opened if printing is performed on paper other than the paper that is determined to have run out by the error analysis means 40 even when the paper-out is determined by the error analysis means 40.

In the inkjet recording device in accordance with an eleventh aspect of the present invention, the valve 21*b* is installed in a path 6*c* that runs to an atmospheric opening aperture 8*b* of the reservoir 3 in the ink supplying system, and the valve switching control means 22 controls the valve 21*b* to be closed during a pause of the printing when the printing operation by the ink head 4 is not performed, and controls the valve 21*b* to be opened for a certain period of time when a change of a pressure on the ink discharging plane 5*a* of the ink head 4 is detected by the pressure detecting means 10 during the pause of the printing.

In the inkjet recording device in accordance with a twelfth aspect of the present invention, the path 6*a* between the reservoir 3 and the ink head 4 is opened in the ink supplying system while power supply of the inkjet recording device 1A is OFF in accordance with the fourth aspect.

According to the inkjet recording device in accordance with the first aspect of the present invention, it is possible to prevent or suppress transmission of the change of the ink liquid level in the reservoir to the ink discharging plane by controlling the valve installed in the path of the ink supplying system to be closed by the valve switching control means when the ink jet recording device vibrates and interrupting this path. Therefore, the meniscus formed in the ink discharging plane does not break even if the device vibrates by an external operation etc., and as a result, a defective ink discharge can be prevented.

Moreover, according to the inkjet recording device in accordance with the second aspect, it becomes easy to detect the vibration by detecting the pressure of the ink discharging plane, and it is possible to prevent the meniscus of the ink discharging plane from breaking due to causes other than vibration.

In addition, according to the inkjet recording device in accordance with the third aspect, it is possible to directly prevent transmission of the change of the ink liquid level in the reservoir to the ink discharging plane if the path is interrupted by controlling the valve to be closed, by installing the valve in the path between the reservoir and ink head. Moreover, the meniscus of the ink discharging plane can be prevented from breaking even when unexpected vibration or impact occurs during the printing operation without negative influence on the ink supply to the ink head.

Moreover, according to the inkjet recording device in accordance with the fourth aspect, the meniscus can surely be prevented from breaking by controlling the valve to be closed until the pressure of the ink discharging plane reaches the value (safety value) within the predetermined range where the meniscus does not break and interrupting the path between the reservoir and the ink head. The change of the ink liquid level in the reservoir is not transmitted to the ink discharging plane, because this path is interrupted until the pressure of the ink discharging plane reaches the safety value even during the pause of the printing when the path between the reservoir and the ink head is usually opened.

In addition, according to the inkjet recording device in accordance with the fifth aspect, the meniscus can be prevented from breaking by controlling the valve to be closed until the pressure of the ink discharging plane reaches the value (safety value) in the predetermined range where the meniscus does not break and interrupting the path between the reservoir and the ink head, even if the inkjet recording device during the pause of the printing vibrates by an external operation. It is possible to directly prevent transmission of the change of the ink liquid level in the reservoir to the ink discharging plane by interrupting the path between the reservoir and the ink head, because there is no problem in the ink supply if the print is stopped.

Moreover, according to the inkjet recording device in accordance with the sixth aspect, transmission of the change of the ink liquid level in the reservoir by an error (vibration) to the ink discharging plane is prevented, by establishing or registering in advance an error (predetermined error), for example, the error such as vibration of the device to the error analysis means.

In addition, according to the inkjet recording device in accordance with the seventh aspect, transmission of the change of the ink liquid level in the reservoir to the ink discharging plane is prevented even if the inkjet recording device vibrates due to the stop of the printing operation.

Also, according to the inkjet recording device in accordance with the eighth aspect, transmission of the change of the ink liquid level in the reservoir to the ink discharging plane is prevented even if the inkjet recording device vibrates due to paper jamming, and in addition, the meniscus can be prevented from breaking by the vibration during work to resolve the paper jamming.

In addition, according to the inkjet recording device in accordance with the ninth aspect, transmission of the change of the ink liquid level in the reservoir to the ink discharging plane is prevented even if the inkjet recording device vibrates due to the paper-out, and in addition the meniscus can be prevented from breaking by the vibration during work to refill the paper.

Moreover, according to the inkjet recording device in accordance with the tenth aspect, since use of paper other than the paper which ran out prevents vibration of the inkjet recording device, controlling the valve is not necessary.

In addition, according to the inkjet recording device in accordance with the eleventh aspect, transmission of the change of the ink liquid level in the reservoir during the pause of the printing to the ink discharging plane can be prevented by installing the valve in the path that the valve runs to an atmospheric opening aperture of the reservoir and by controlling this valve to be closed and interrupting an atmospheric opening of the reservoir.

Moreover, according to the inkjet recording device in accordance with the twelfth aspect, power consumption can be suppressed while the power supply is OFF.

BRIEF DESCRIPTION OF THE DRAWINGS

FIG. 5A is a comparison diagram that shows experimental results when interrupting between the reservoir and the ink heads and when interrupting an atmospheric opening aperture of the reservoir;

FIG. 5B is a drawing that shows the details of the control corresponding to the operating condition of the first embodiment;

DETAILED DESCRIPTION OF THE PREFERRED EMBODIMENTS

Figure 1:
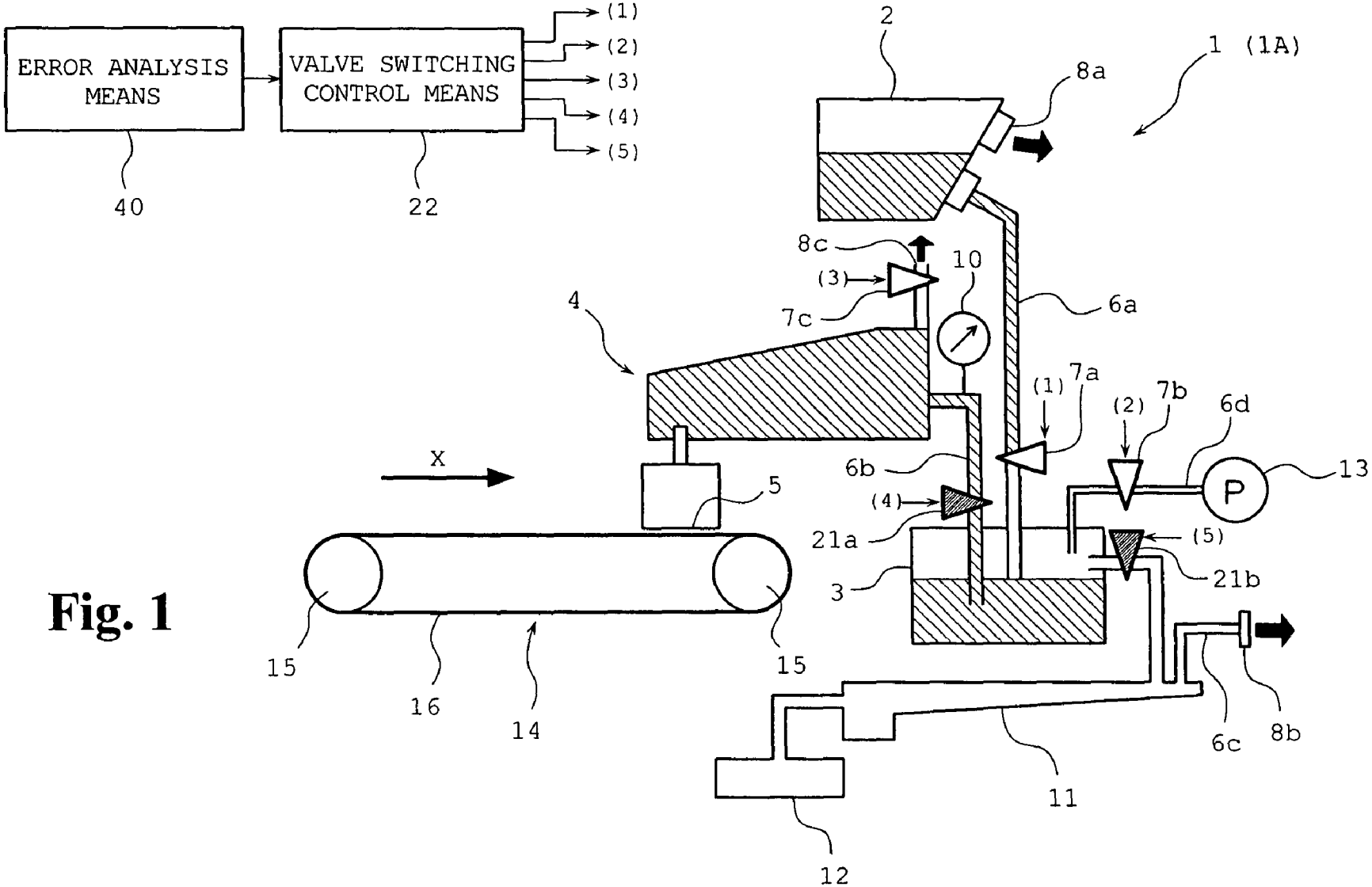
FIG. 1 is a drawing that depicts a configuration of the path of a first embodiment of the inkjet recording device according to the present invention.

The inkjet recording device 1 according to the present invention for respective embodiments is described referring to the drawings as follows.

First Embodiment

Figure 2:
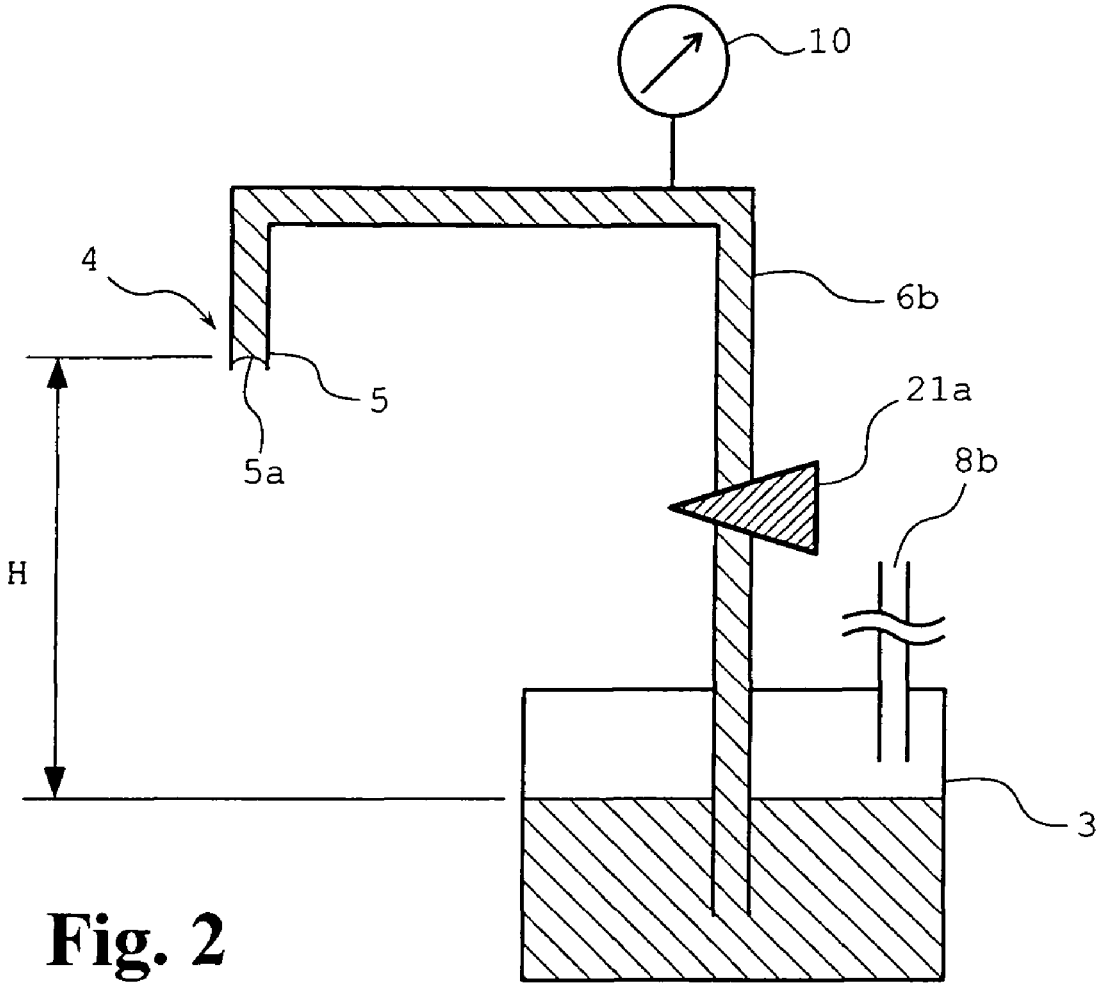
FIG. 2 is a drawing that depicts the relationship of the reservoir and the ink head in the first embodiment.
Figure 3:
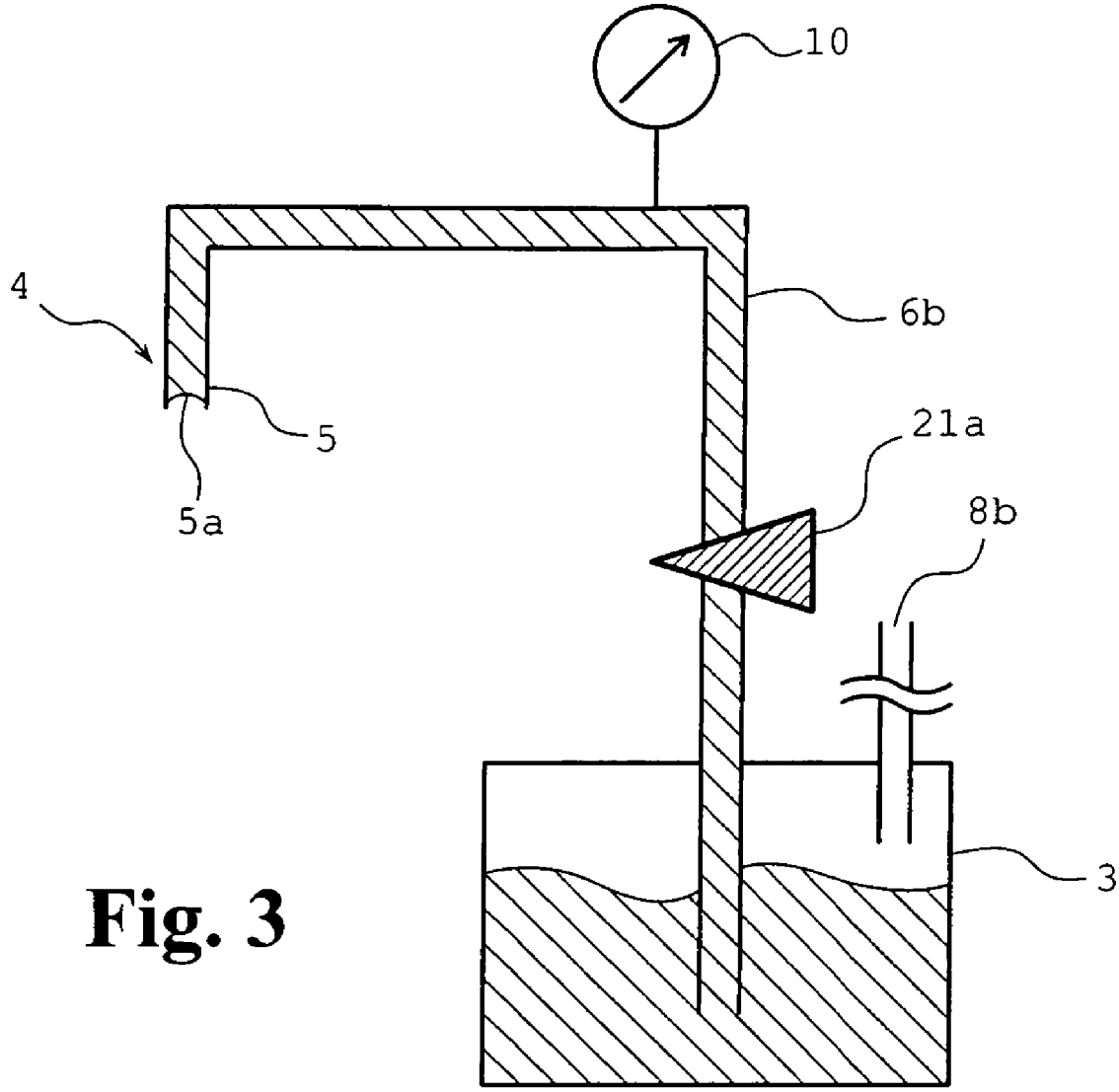
FIG. 3 is a drawing that depicts the relationship of the reservoir and the ink head during the printing operation of the first embodiment.
Figure 4:
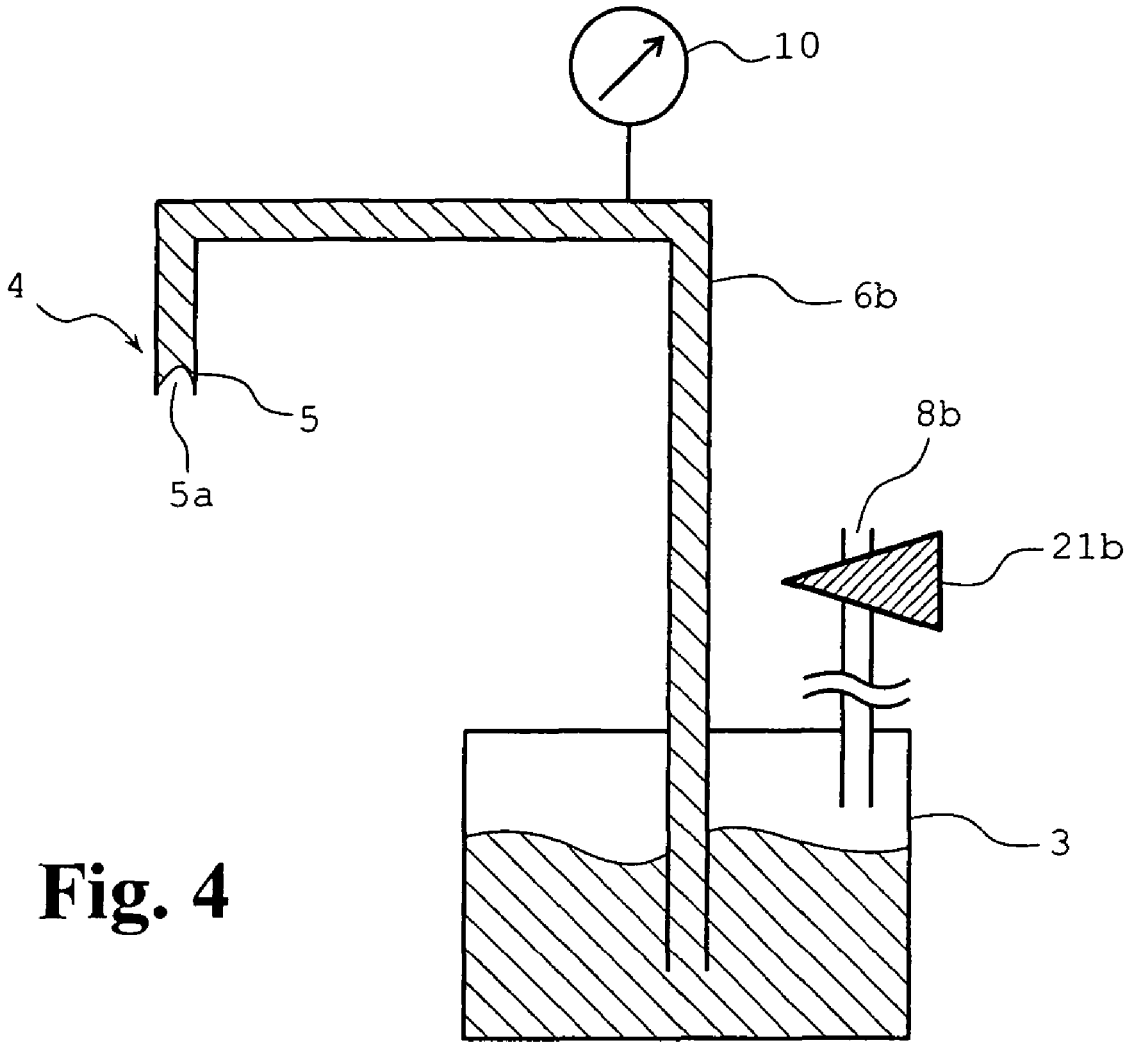
FIG. 4 is a drawing that depicts the relationship of the reservoir and the ink head during the pause of the printing of the first embodiment.

FIG. 1 is a drawing that depicts a configuration of the path of a first embodiment of the inkjet recording device according to the present invention, and FIGS. 2 to 4 are drawings that depict the relationship of the reservoir and the ink head in the first embodiment.

The first embodiment is the inkjet recording device 1A that discharges ink from discharge entrance of an ink head in response to image data and prints it on a recording medium such as printing paper.

Figure 8:
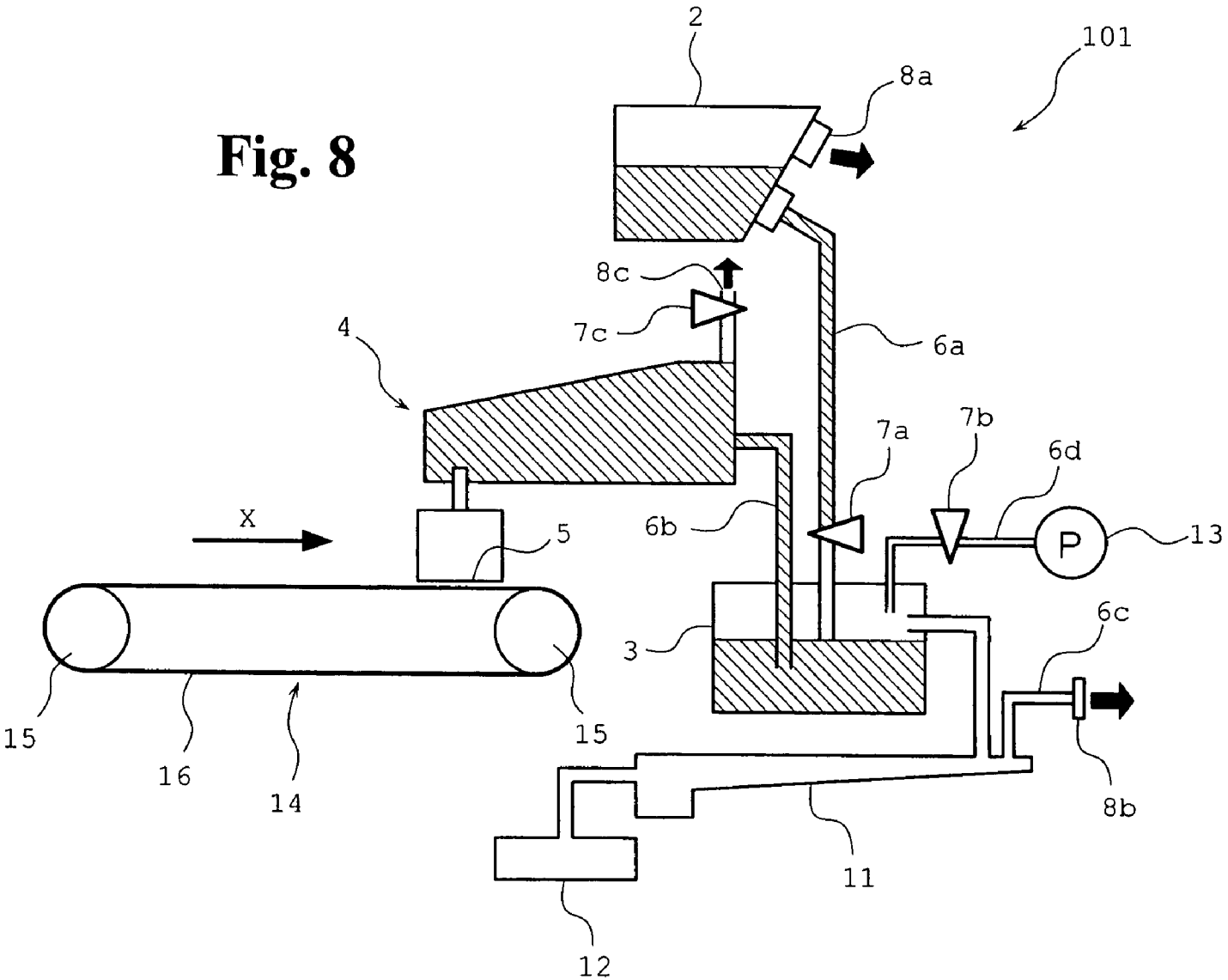
FIG. 8 is a drawing that depicts the configuration of the path of an inkjet recording device of the related art.
Figure 9A:
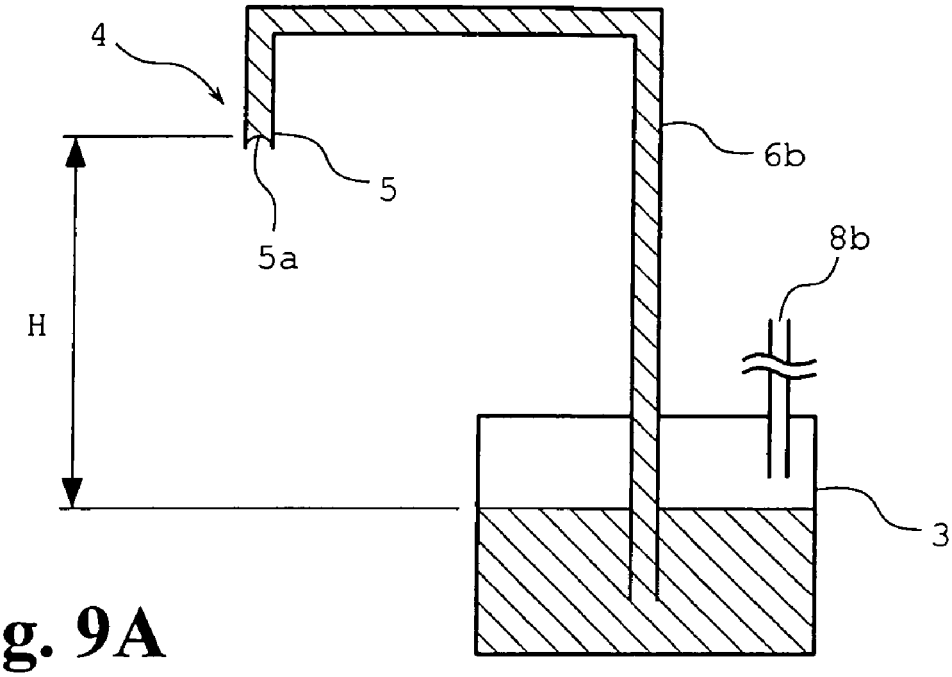
FIG. 9A and FIG. 9B are drawings that depict the relationship of the reservoir and the ink head in the device.
Figure 9B:
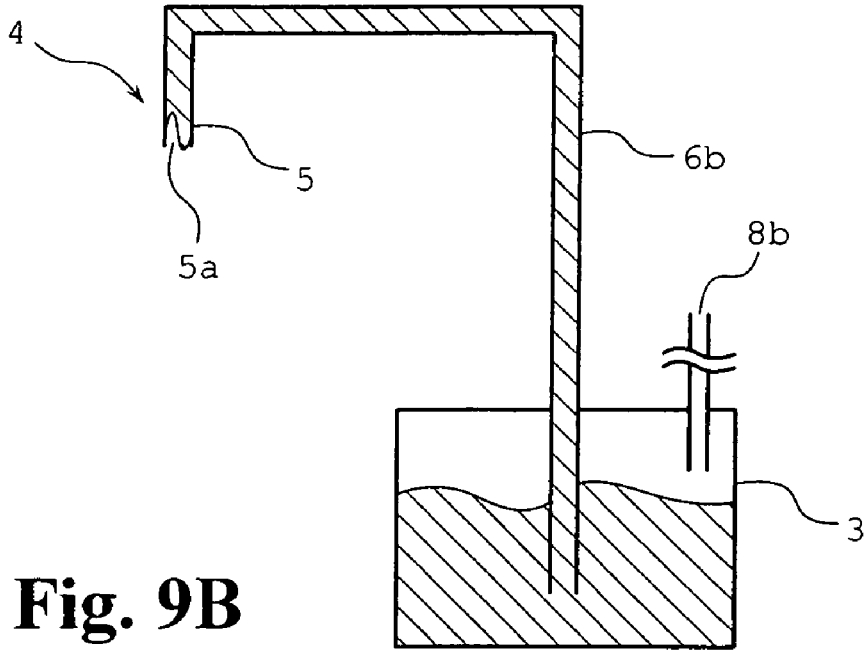
Figure 10:
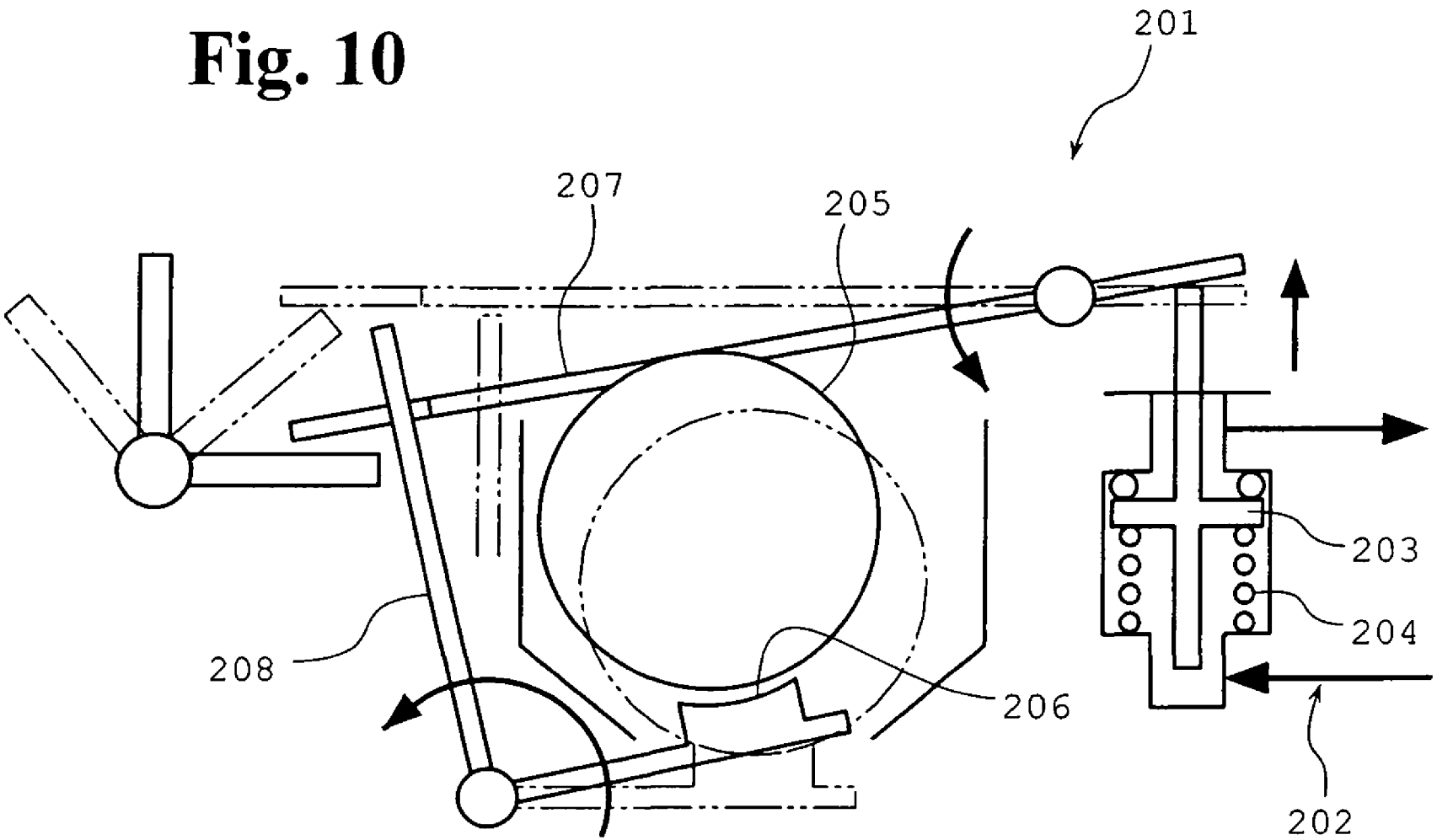
FIG. 10 is a drawing that depicts an ink leakage preventing mechanism of the related art.

The most of the configuration of the first embodiment is equal to that of the above-mentioned inkjet recording device 101 (Refer to FIG. 8). Thus, the equivalent part or the same part as that of the above-mentioned inkjet recording device 101 is marked with the same reference number, and the explanation thereof will be omitted.

A control electromagnetic valve 21*a* that opens and interrupts the path 6*b* by controlling opening/closing by the valve switching control means 22 is installed in the path 6*b* between the reservoir 3 and the ink head 4 in the ink supplying system as shown in FIG. 1. Moreover, a control electromagnetic valve 21*b* that opens and interrupts the path 6*c* by controlling opening/closing by the valve switching control means 22 is installed in the path 6*c* that runs to the atmospheric opening aperture 8*b* of the reservoir 3 in the ink supplying system. The speed of response of these control electromagnetic valve 21*a* and 21*b* is faster than that of a general electromagnetic valve.

Moreover, the valve switching control means 22 to control the opening/closing of the control electromagnetic valve 21*a* and 21*b* may be the same one as the valve switching control means to control the opening/closing of the above-mentioned electromagnetic valves 7*a* to 7*c*, and it may be the one installed only to control the opening/closing of the control electromagnetic valve 21*a* and 21*b*. Also, the configuration of the former is adopted in FIG. 1, in which three electromagnetic valves 7*a* to 7*c* and two control electromagnetic valves 21*a* and 21*b* can be collectively controlled by valve switching control means 22 so as to be opened and closed.

In addition, a pressure gauge 10 as the above-mentioned pressure detecting means to detect the pressure of the ink discharging plane 5*a* of the ink head 4 (Refer to FIGS. 2 to 4) is installed on the side of the ink head 4 from the control electromagnetic valve 21*a* in the path 6*b* between the reservoir 3 and the ink head 4.

Hereinafter, the relationship between the ink liquid level in the reservoir and the ink discharging plane at the discharge entrance of the ink head during the printing operation or the pause of the printing will be described in reference to FIGS. 2 to 4.

As shown in FIG. 2, if the ink liquid level in the reservoir 3 is stable during the printing operation of the ink head 4, the meniscus formed to the ink discharging plane 5*a* of the ink head 4 (discharge entrance 5) by water head difference H from this ink liquid level is also stable. At this time, the valve switching control means 22 (Refer to FIG. 1) controls the control electromagnetic valve 21*a* to be opened and opens the path 6*b* between the reservoir 3 and the ink head 4 for the ink supply.

As shown in FIG. 3, the ink liquid level in the reservoir 3 changes, if the device 1A vibrates, for example by an external operation such as the collision of a person or a thing, etc. The pressure gauge 10 detects the change of the pressure of the ink discharging plane 5*a* at the moment this change is transmitted to the ink discharging plane 5*a*. When the pressure gauge 10 detects the change of the pressure of the ink discharging plane 5*a*, the valve switching control means 22 (Refer to FIG. 1) promptly controls the control electromagnetic valve 21*a* to be closed, and interrupts the path 6*b* between the reservoir 3 and the ink head 4, so as not to transmit any further change of the ink liquid level in the reservoir 3 to the ink discharging plane 5*a*. As a result, the meniscus of the ink discharging plane 5*a* is not influenced by the change of the ink liquid level in the reservoir 3 and remains stable. The control electromagnetic valve 21*a* interrupts the path 6*b* until the pressure gauge 10 detects the safety value at which the meniscus of the ink discharging plane 5*a* does not break. Moreover, the valve switching control means 22 controls the control electromagnetic valve 21*a* to be opened and opens the path 6*b* during the pause of the printing between a printing operation and another printing operation. However, when the pressure gauge 10 detects the change of the pressure of the ink discharging plane 5*a*, the valve switching control means 22 controls the control electromagnetic valve 21*a* to be closed until the pressure gauge 10 detects the safety value at which the meniscus of the ink discharging plane 5*a* does not break even during a pause of the printing, and interrupts the path 6*b*.

Moreover, as shown in FIG. 4, if the pressure gauge 10 detects the change of the pressure of the ink discharging plane 5*a* when the device 1A vibrates during the pause of the printing when the printing operation of the ink head 4 is not performed, the valve switching control means 22 (Refer to FIG. 1) promptly controls the control electromagnetic valve 21*b* to be closed and interrupts the path 6*c* that runs to atmospheric opening aperture 8*b* of the reservoir 3. Therefore, unnecessary air does not enter into the reservoir 3, and the change of the pressure by the inflow of air can be suppressed. As a result, the influence on the meniscus of the ink discharging plane 5*a* can be reduced. The control electromagnetic valve 21*b* interrupts the atmospheric opening aperture 8*b* until the pressure gauge 10 detects the safety value at which the meniscus of the ink discharging plane 5*a* does not break, just like the above-mentioned control electromagnetic valve 21*a*.

Here, referring to FIG. 5, description is given of the effectiveness for interrupting between the reservoir and the ink head when the device vibrates during the printing operation, and interrupting the atmospheric opening aperture of the reservoir when the device vibrates during the pause of the printing.

The inventors of the present invention conducted the experiment in which they artificially applied vibration to an inkjet recording device during the printing operation of the ink head, and obtained the result shown in FIG. 5A by this experiment.

First of all, if the device is interrupted between the reservoir 3 and the ink head 4 when the device 1A vibrates, an excellent result of printing similar to that of a normal case is obtained with shakes in general such as big and small shakes, vertical shakes and horizontal shakes. Thus, it is found that it is effective to big shakes when interrupted between the reservoir 3 and the ink head 4. On the other hand, it is found that the ink of the path 6*b* will disappear in a short time by interrupting between the reservoir 3 and the ink head 4, and it has a negative influence on the ink supply easily.

Next, if the atmospheric opening aperture 8*b* of the reservoir 3 was interrupted when the device 1A vibrated, excellent printing results were obtained for the horizontal shake but a defective ink discharge was generated in the vertical shake. As a result, it is found that it is weak to a vertical shake or a big shake if the atmospheric opening aperture 8*b* of the reservoir 3 is interrupted. On the other hand, the influence on the ink supply was small.

Then, the inventors of the present invention decided to interrupt, in principle, the path 6*b* between the reservoir 3 and the ink head 4 during the printing operation, and control the opening/closing of the control electromagnetic valve 21*a* so as to open this path 6*b* only between a printing operation and another printing operation by the ink head 4, that is, between the printing paper to be printed and the printing paper to be printed as follows (between the papers), as shown in FIG. 5B.

Moreover, they decided to control the opening/closing of the control electromagnetic valve 21*b* to interrupt the path 6*c* that ran to the atmospheric opening aperture 8*b* of the reservoir 3 during the pause of the printing and to open this path 6*c* when the pressure gauge 10 detected the change of the pressure of ink discharging plane 5*a* of the ink head 4.

In addition, it was decided to interrupt the path 6*b* between the reservoir 3 and the ink head 4 by the control electromagnetic valve 21*a* when the device 1A vibrated during the pause of the printing, and the pressure gauge 10 detects the change of the pressure of the ink discharging plane 5*a*; however, the control electromagnetic valve 21*a* was controlled for opening and closing, to open this path 6*b* when the vibration calmed down, that is, the pressure gauge 10 detected the safety value. Moreover, it was decided to open both of two paths 6*a* and 6*c* while the power supply of the device 1A was OFF, because maintenance was performed while the power supply was ON.

Furthermore, the first embodiment further includes error analysis means 40 to analyze the error that occurs during the printing operation. The error analysis means 40 has errors such as the vibration of the device set or registered in advance. The errors set or registered in advance include a paper jamming error or a paper-out error, etc. There is a possibility that the device 1A vibrates when the both errors occur or the error is resolved and the device returns to normal status.

For examples, when an error is determined as the paper jamming by the error analysis means 40, the valve switching control means 22 controls the control electromagnetic valve 21*a* to be closed to interrupt the path 6*b* between the reservoir 3 and the ink head 4, and prevents transmission of the change of the ink liquid level in the reservoir 3 to the ink discharging plane 5*a*. The valve switching control means 22 controls the control electromagnetic valve 21*a* to be opened after the paper jamming is resolved and a predetermined time has passed, so as to open the path 6*b*.

For example, when an error is determined as paper-out by the error analysis means 40, the valve switching control means 22 controls the control electromagnetic valve 21*a* to be closed, so as to interrupt the path 6*b* between the reservoir 3 and the ink head 4 as well as the above-mentioned configuration, and prevents transmission of the change of the ink liquid level in the reservoir 3 to the ink discharging plane 5*a*. The valve switching control means 22 controls the control electromagnetic valve 21*a* to be opened after refill of the paper is completed and a predetermined time has passed, to open the path 6*b*. Moreover, the valve switching control means 22 controls the control electromagnetic valve 21*a* to be opened when printing is performed on paper other than the paper that is determined to have run out by the error analysis means 40 even when an error is determined as the paper-out by the error analysis means 40, to open the path 6*b*. In other words, for examples, the device 1A does not vibrate since the printing operation does not stop when it can print on B4 paper even in the state where A4 paper is out. Therefore, the control electromagnetic valve 21*a* does not need to be controlled to be closed.

Moreover, when an error occurs in the device 1A, the control electromagnetic valve 21*a* is controlled to be closed between the time when the error analysis means 40 determines the error as the above-mentioned predetermined error and the time when the printing operation stops, and the path 6*b* is closed.

Moreover, the control electromagnetic valves 21*a* and 21*b* are opened when the power supply of the device 1A is OFF, thus power consumption can be suppressed.

Second Embodiment

Figure 6:
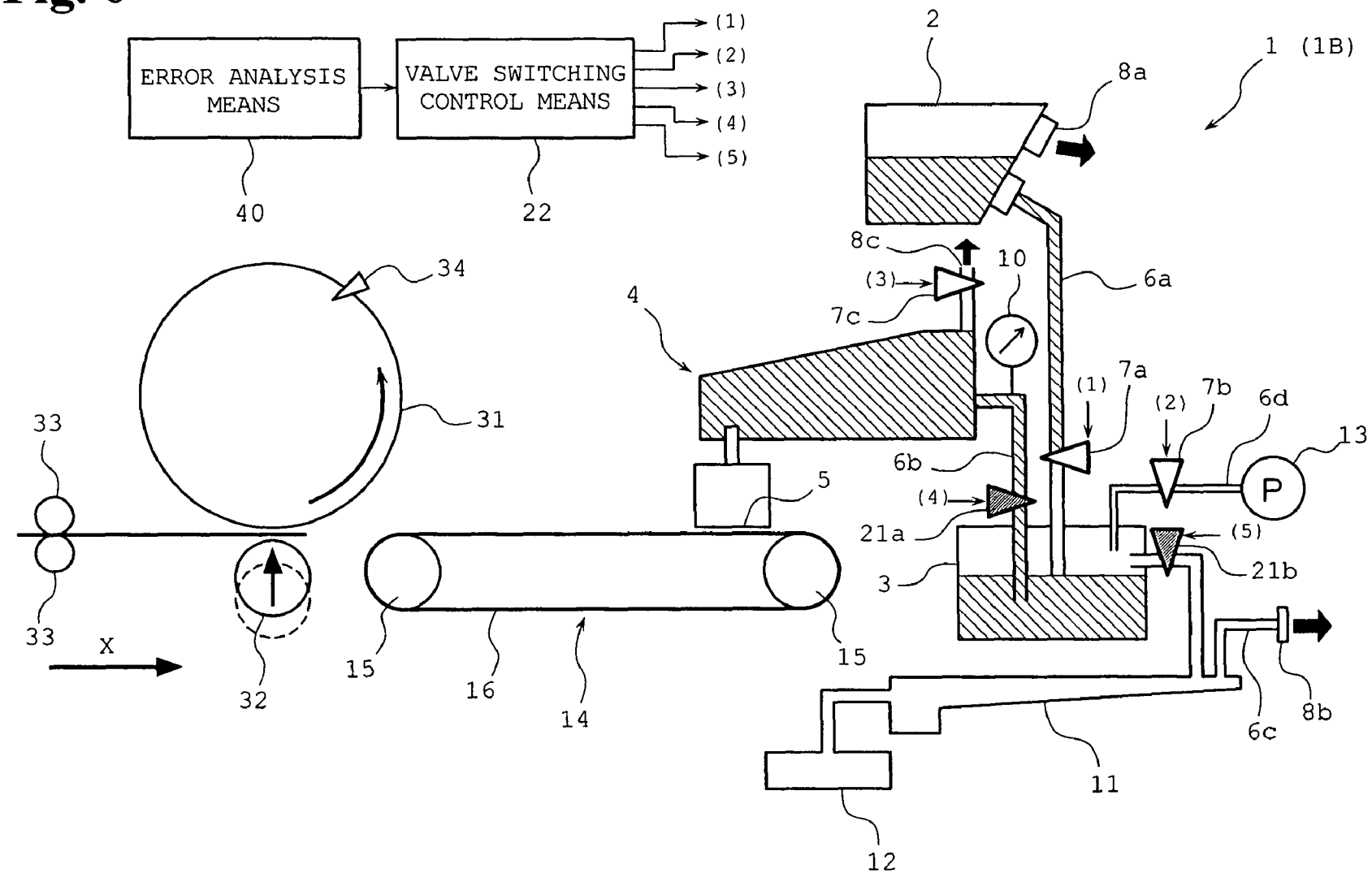
FIG. 6 is a drawing that depicts the configuration of the path of a second embodiment of the inkjet recording device according to the present invention.
Figure 7:
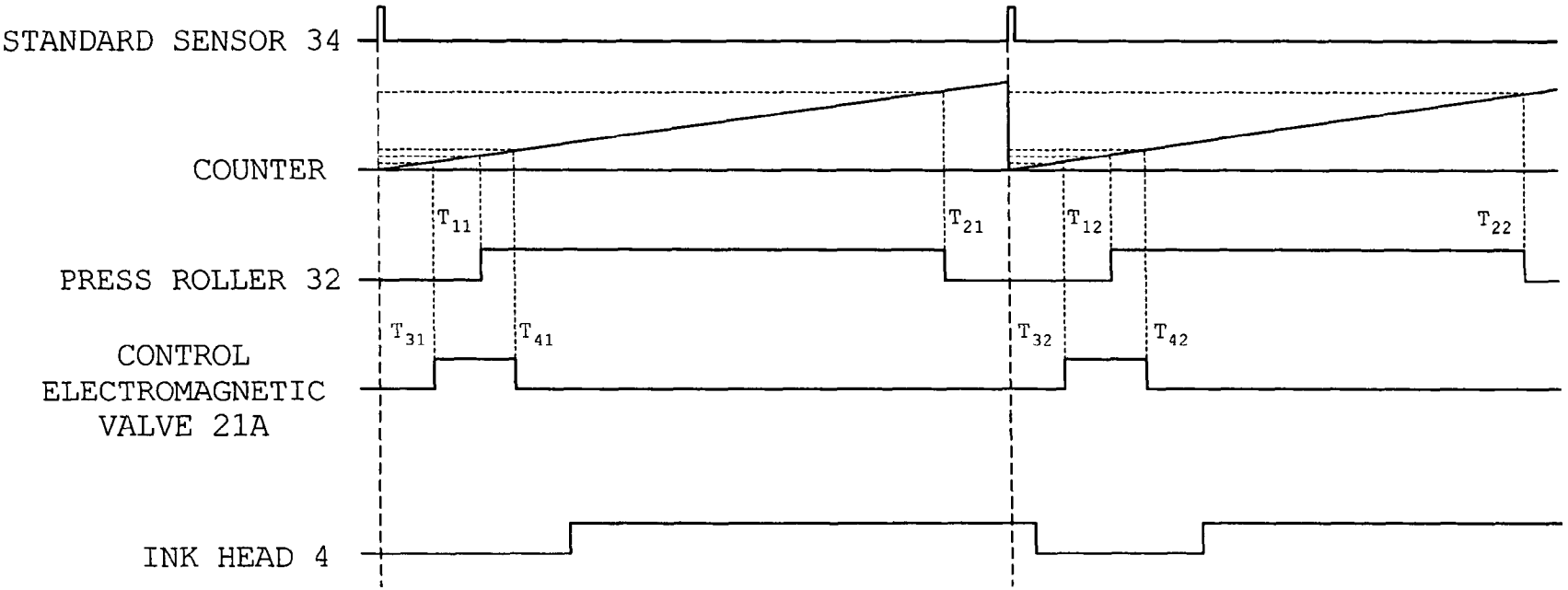
FIG. 7 is a timing chart that shows the relationship of each part during the printing operation of the second embodiment.

FIG. 6 is a drawing that depicts a configuration of the path of a second embodiment of the inkjet recording device according to the present invention, and FIG. 7 is a timing chart that shows the relationship of each part during the printing operation of the second embodiment.

The second embodiment is the inkjet recording device that discharges ink from the discharge entrance of an ink head in response to image data and performs printing on a recording medium such as printing paper and in addition, is of a hybrid type device with a print drum.

Also, the most of the configuration of the second embodiment is equal to those of the above-mentioned inkjet recording device 101 (Refer to FIG. 8) and the first embodiment. Thus, the equivalent part to or the same part as those of the above-mentioned inkjet recording device 101 and the first embodiment is marked with the same reference number, and the explanation thereof will be omitted.

As shown in FIG. 6, a press roller 32 to press printing paper P transported by transportation rollers 33 and 33 against a print drum 31 is installed under the print drum 31 to which a stencil raw paper which has already been processed is attached. The press roller 32 moves vertically against the print drum 31 at a predetermined cycle. In addition, a standard sensor 34 to detect the rotation of the drum to set the standard is installed in the print drum 31.

Here, referring to FIG. 7, the relationship of the ink discharge according to the printing operation of the press roller, the control electromagnetic valve and the ink head during the printing operation will be described.

As shown in FIG. 7, the count for one rotation of the print drum 31 starts with the counter when the print drum 31 starts rotating in the second embodiment. The press roller 32 begins to press for the print drum 31 between the predetermined count value $T_{11}$ and $T_{21}$. Moreover, the control electromagnetic valve 21*a* (21*b*) is controlled to be closed under the control of the valve switching control means 22 between predetermined count value $T_{31}$ and $T_{41}$. When the print drum 31 finishes rotating, the counter is reset. When the print drum 31 starts the next rotation, the count by the counter starts again, and the press roller 32 starts to press for the print drum 31 between the predetermined count value $T_{12}$ and $T_{22}$ to control the control electromagnetic valve 21*a* (21*b*) to be closed between the predetermined count value $T_{32}$ and $T_{42}$. That is, even if the device 1B vibrates by the vertical motion of the press roller 32 and the ink liquid level in the reservoir 3 changes, this change is not transmitted to the ink discharging plane 5*a*, because the control electromagnetic valve 21*a* (21*b*) is controlled to be closed and the path 6*b* between the reservoir 3 and the ink head 4 (path 6*c* that runs to the atmospheric opening aperture 8*b* of the reservoir 3) is interrupted when the press is started with the press roller 32. Also, when the control electromagnetic valve 21*a* is opening the path 6*b* (between the predetermined count values $T_{41}$ and $T_{32}$ in FIG. 7), the ink head 4 discharges ink.

According to the above-mentioned first and second embodiment, it is possible to prevent or suppress transmission of the change of the ink liquid level in the reservoir 3 to the ink discharging plane 5*a*, by controlling the control electromagnetic valves 21*a* and 21*b* installed at the predetermined position of the ink supplying system to be closed with the valve switching control means 22 and interrupting the path 6*b* between the reservoir 3 and the ink head 4 or the path 6*c* that runs to the atmospheric opening aperture 8*b* of the reservoir 3 when the device 1 (1A and 1B) vibrates. Therefore, the meniscus formed in the ink discharging plane 5*a* does not break even if the device 1 (1A, 1B) vibrates by an external operation, etc. As a result, defective ink discharge can be prevented.

Moreover, according to the above-mentioned first embodiment, it becomes easy to detect the vibration by detecting the pressure of the ink discharging plane 5*a* with the pressure gauge 10, and it is possible to prevent the meniscus of the ink discharging plane 5*a* from breaking due to causes other than the vibration.

In addition, it is possible to directly prevent transmission of the change of the ink liquid level in the reservoir 3 to the ink discharging plane 5*a* if the path 6*b* is interrupted by controlling the control electromagnetic valve 21*a* to be closed, by installing the control electromagnetic valve 21*a* in the path 6*b* between the reservoir 3 and the ink head 4. Moreover, the meniscus of the ink discharging plane 5*a* can be prevented from breaking even if unforeseeable vibration or impact occurs during the printing operation without negative influence on the ink supply to the ink head 4.

Moreover, the meniscus can surely be prevented from breaking by controlling the control electromagnetic valve 21*a* to be closed until the pressure of the ink discharging plane 5*a* reaches the value in the predetermined range (safety value) where the meniscus does not break and interrupting the path 6*b* between the reservoir and the ink head even when the device 1A during a printing operation vibrates. The change of the ink liquid level in the reservoir 3 is not transmitted to the ink discharging plane, because this path 6*b* is interrupted until the pressure of the ink discharging plane 5*a* reaches the safety value even during the pause of the printing when the path 6*b* between the reservoir 3 and the ink head 4 is usually opened.

In addition, the errors that cause the device 1A to vibrate such as a paper jamming error or a paper-out error are set or registered in advance to the error analysis means 40 and if the error analysis means 40 determines an error as the predetermined error when the error occurs in the device 1A, the control electromagnetic valve 21*a* is controlled to be closed to interrupt the path 6*b*. As a result, the change of the ink liquid level in the reservoir 3 is not transmitted to the ink discharging plane 5*a* even if the device 1A vibrates due to an error, and in addition the meniscus can be prevented from breaking by the vibration during the work for the return to a normal state.

Also, even if the device 1A during the pause of the printing vibrates by an external operation, the meniscus can be prevented from breaking by controlling the control electromagnetic valve 21*b* to be closed until the pressure of the ink discharging plane 5*a* reaches the value in the predetermined range (safety value) where the meniscus does not break and interrupting the path 6*c*. If the print is stopped, it is possible to interrupt the path 6*b* between the reservoir 3 and the ink head 4, because there is no problem in the ink supply. As a result, it is possible to directly prevent transmission of the change of the ink liquid level in the reservoir 3 to the ink discharging plane 5*a*.

In addition, according to the above-mentioned second embodiment, transmission of the change of the ink liquid level in the reservoir 3 to the ink discharging plane 5*a* is prevented, by estimating a regular vertical motion of the press roller 32 and by controlling the control electromagnetic valve 21*a* to be closed and by interrupting the path 6*b* for the inkjet recording device 1B of the hybrid type with a print drum 31.

The higher the press pressure of the press roller 32 is, the longer the vibration lasts, thus the control electromagnetic valve 21*a* can be controlled to be closed and the path 6*b* can be interrupted in response to this period of time. Therefore, transmission of the change of the ink liquid level in the reservoir 3 to the ink discharging plane 5*a* is prevented even when the press pressure of the press roller 32 is high.

Moreover, the above-mentioned first embodiment has the configuration that can detect the pressure of ink discharging plane 5*a* of the ink head 4 (discharge entrance 5) with the pressure gauge 10, but it may also have the configuration that the vibration is directly detected by a vibration meter, etc.

What is claimed is:

1. An inkjet recording device having an ink tank, a reservoir that temporarily stores the ink supplied from the ink tank and an ink head that discharges the ink supplied from the reservoir and performs printing, forming an ink supplying system by connecting with a path between the ink tank and the reservoir and between the reservoir and the ink head respectively, and forming a meniscus by generating a negative pressure on an ink discharging plane of the ink head by opening the reservoir to atmosphere, the inkjet recording device comprising:

valves installed in predetermined paths of the ink supplying system to open or interrupt the paths; and valve switching control means for controlling opening/closing of the valves, wherein the valves are controlled to be closed by the valve switching control means when the ink jet recording device vibrates.

2. The inkjet recording device according to claim 1, wherein pressure detecting means for detecting the pressure applied to the ink discharging plane of the ink head for detecting the vibration of the inkjet recording device is installed.

3. The inkjet recording device according to claim 2, wherein the valve is installed in a path between the reservoir and the ink head in the ink supplying system, and the valve switching control means controls the valve to be closed during a printing operation by the ink head and controls the valve to be opened during a pause of the printing between a printing operation and another printing operation.

4. The inkjet recording device according to claim 3, wherein when a change of the pressure on the ink discharging plane of the ink head is detected by the pressure detecting means during the printing operation by the ink head, the valve switching control means controls the valve to be closed until the change of the pressure comes into a predetermined range even after the ink head enters the pause of the printing.

5. The inkjet recording device according to claim 3, wherein when a change of the pressure on the ink discharging plane of the ink head is detected by the pressure detecting means during the pause of the printing when the printing operation by the ink head is not performed, the valve switching control means controls the valve to be closed until the change of the pressure comes into a predetermined range.

6. An inkjet recording device having an ink tank, a reservoir that temporarily stores the ink supplied from the ink tank and an ink head that discharges the ink supplied from the reservoir and performs printing, forming the ink supplying system by connecting with a path between the ink tank and the reservoir and between the reservoir and the ink head respectively, and forming a meniscus by generating a negative pressure on an ink discharging plane of the ink head by opening the reservoir to atmosphere, the inkjet recording device comprising:

a valve installed in a path between the reservoir and the ink head in the ink supplying system to open or interrupt the path;

valve switching control means installed to control opening/closing of the valve, for controlling the valve to be closed when the ink jet recording device vibrates;

pressure detecting means installed to detect the vibration of the inkjet recording device, for detecting the pressure applied to the ink discharging plane of the ink head; and error analysis means for analyzing an error that occurs during the printing operation by the ink head, wherein the valve switching control means controls the valve to be closed during the printing operation by the ink head; controls the valve to be opened during a pause of the printing between a printing operation and another printing operation of the ink head;

controls the valve to be closed until a change of the pressure comes into a predetermined range even after the ink head enters the pause of the printing when the change of the pressure applied to the ink discharging plane of the ink head is detected by the pressure detecting means during the printing operation; controls the valve to be closed until the change of the pressure comes into a predetermined range when the change of the pressure is detected by the pressure detecting means during the pause of the printing when the printing operation is not performed; and controls the valve to be closed when an error is determined as a predetermined error by the error analysis means if the printing operation stops due to the error during the printing operation.

7. The inkjet recording device according to claim 6, wherein when an error is determined as the predetermined error by the error analysis means, the valve switching control means controls the valve to be closed between the determination by the error analysis means and a time when the printing operation stops.

8. The inkjet recording device according to claim 6, wherein the predetermined error includes paper jamming and the valve switching control means controls the valve to be closed when an error is determined as the paper jamming by the error analysis means and controls the valve to be opened after the paper jamming is resolved and a predetermined time has passed.

9. The inkjet recording device according to claim 6, wherein the predetermined error includes paper-out and the valve switching control means controls the valve to be closed when an error is determined as the paper-out by the error analysis means and controls the valve to be opened after refill of paper is completed and a predetermined time has passed.

10. An inkjet recording device having an ink tank, a reservoir that temporarily stores the ink supplied from the ink tank and an ink head that discharges the ink supplied from the reservoir and performs printing, forming an ink supplying system by connecting with a path between the ink tank and the reservoir and between the reservoir and the ink head respectively, and forming a meniscus by generating a negative pressure on an ink discharging plane of the ink head by opening the reservoir to atmosphere, the inkjet recording device comprising:

a valve installed in a path between the reservoir and the ink head in the ink supplying system to open or interrupt the path;

valve switching control means installed to control opening/closing of the valve, for controlling the valve to be closed when the ink jet recording device vibrates; and error analysis means for analyzing an error that occurs during the printing operation by the ink head, wherein the valve switching control means controls the valve to be closed during the printing operation by the ink head; controls the valve to be opened during a pause of the printing between a printing operation and another printing operation; controls the valve to be closed when an error is determined as a predetermined error by the error analysis means if the printing operation stops due to the error during the printing operation; controls the valve to be closed when the predetermined error includes paper-out and an error is determined as the paper-out by the error analysis means and controls the valve to be opened after refill of the paper is completed and a predetermined time has passed; and controls the valve to be opened if printing is performed on paper other than the paper that is determined to have run out by the error analysis means even when an error is determined as the paper-out by the error analysis means.

11. The inkjet recording device according to claim 2, wherein the valve is installed in a path that runs to an atmospheric opening aperture of the reservoir in the ink supplying system, and the valve switching control means controls the valve to be closed during a pause of the printing when the printing operation by the ink head is not performed, and controls the valve to be opened for a certain period of time when a change of a pressure on the ink discharging plane of the ink head is detected by the pressure detecting means during the pause of the printing.

12. The inkjet recording device according to claim 4, wherein the path between the reservoir and the ink head is opened in the ink supplying system while power supply of the inkjet recording device is OFF.

* * * * *